US009216506B2

(12) United States Patent
Geiger et al.

(10) Patent No.: US 9,216,506 B2
(45) Date of Patent: Dec. 22, 2015

(54) HANDLE BARRIER

(71) Applicants: Luisa Maria Geiger, Azusa, CA (US); Robert Karl Geiger, Azusa, CA (US)

(72) Inventors: Luisa Maria Geiger, Azusa, CA (US); Robert Karl Geiger, Azusa, CA (US)

( * ) Notice: Subject to any disclaimer, the term of this patent is extended or adjusted under 35 U.S.C. 154(b) by 3 days.

(21) Appl. No.: 14/254,685

(22) Filed: Apr. 16, 2014

(65) Prior Publication Data

US 2015/0298313 A1 Oct. 22, 2015

(51) Int. Cl.
*B25G 1/10* (2006.01)
*E05B 1/00* (2006.01)

(52) U.S. Cl.
CPC ..... *B25G 1/10* (2013.01); *E05B 1/0069* (2013.01); *Y10T 16/48* (2015.01)

(58) Field of Classification Search
CPC ..... Y10S 16/904; Y10T 16/48; Y10T 16/44; Y10T 16/466; Y10T 16/469; Y10T 16/4713; E05B 1/0069; A47K 13/105; A47K 17/00; B62B 5/069; B25G 1/10
USPC ..... 16/431, 110.1, 421, 422, 426, 904
See application file for complete search history.

(56) References Cited

U.S. PATENT DOCUMENTS

| | | | | |
|---|---|---|---|---|
| 4,879,780 | A | 11/1989 | Prebeck | |
| 4,955,914 | A * | 9/1990 | Caniglia et al. | 606/235 |
| D521,207 | S * | 5/2006 | Anderson et al. | D34/27 |
| 7,934,320 | B2 | 5/2011 | Gratsias et al. | |
| 2006/0230576 | A1 * | 10/2006 | Meine | 16/110.1 |
| 2009/0188955 | A1 | 7/2009 | Bizzell et al. | |
| 2010/0281781 | A1 * | 11/2010 | Badgley et al. | 49/460 |
| 2012/0240307 | A1 * | 9/2012 | Terrell et al. | 2/158 |
| 2013/0206054 | A1 * | 8/2013 | Vicente | 116/200 |
| 2014/0173867 | A1 * | 6/2014 | Strombeck et al. | 29/402.08 |

FOREIGN PATENT DOCUMENTS

| | | | |
|---|---|---|---|
| DE | 10305142 | A1 * | 8/2004 |
| KR | 2010046442 | A * | 5/2010 |

* cited by examiner

*Primary Examiner* — William Miller
(74) *Attorney, Agent, or Firm* — Plager Schack LLP

(57) ABSTRACT

A handle barrier is configured to manipulate a handle while keeping a human hand separated from the handle. The handle barrier includes a body portion attached to a rear end having a left rear double arcuate portion, a right rear double arcuate portion, a front end having a left front arcuate portion and a right front arcuate portion. The left front arcuate portion and the right front arcuate portion are configured perpendicular to the body portion and further configured to accommodate the handle. The left front arcuate portion, the right front arcuate portion, the left rear double arcuate portion and the right rear double arcuate portion are further configured to be concave forming a central channel that is configured to accommodate the handle.

7 Claims, 4 Drawing Sheets

HANDLE BARRIER

BACKGROUND

The embodiments herein relate generally to devices that prevent transfer of germs and other pathogens on contaminated surfaces.

Prior to embodiments of the disclosed invention, a handle was manipulated with a user's hand which lead to the transfer of germs and other pathogens. Prior art barriers included tissues which could not be easily reused. The prior art includes: U.S. Pat. No. 7,934,320 issued to Bozikis; U.S. Patent Application 2009/0188955 issued to Bizzell; and U.S. Pat. No. 4,879,780 issued to Prebeck.

Bozikis teaches an arcuate handle designed to accommodate a razor blade, but does not offer a theory of how this can apply to a door handle. Bizzell teaches a handle with two collinear arcuate portions for holding straps but disposes the arcuate portions adjacently and could not use the device to open a door. Prebeck teaches a handle with two arcuate portions, but the arcuate portions are not collinear and therefore cannot be used to open a door.

SUMMARY

A handle barrier is configured to manipulate a handle while keeping a human hand separated from the handle. The handle barrier includes a body portion attached to a rear end having a left rear double arcuate portion, a right rear double arcuate portion, a front end having a left front arcuate portion and a right front arcuate portion. The left front arcuate portion and the right front arcuate portion are configured perpendicular to the body portion and further configured to accommodate the handle. The left front arcuate portion, the right front arcuate portion, the left rear double arcuate portion and the right rear double arcuate portion are further configured to be concave forming a central channel that is configured to accommodate the handle.

In some embodiments, the left rear double arcuate portion further comprises a left rear inward portion which is concave and a left rear forward portion which slopes forward. The right rear double arcuate portion further comprises a right rear inward portion which is concave and a right rear forward portion which slopes forward. The left front arcuate portion has a left front inward portion, which is concave, and a left front rearward portion, which is substantially perpendicular to the body portion. The right front arcuate portion has a right front inward portion, which is concave, and a right front rearward portion, which is substantially perpendicular to the body portion. The left rear forward portion has a left rear forward parallel portion which is immediately adjacent to and perpendicular to the left front rearward portion forming a left front capture notch. The right rear forward portion has a right rear forward parallel portion which is immediately adjacent to and perpendicular to the right front rearward portion forming a right front capture notch. The left front capture notch and the right front capture notch are configured to accommodate the handle.

In some embodiments, the central channel is formed by the left front inward portion, the right front inward portion, the left rear inward portion, and the right rear inward portion. Further, the central channel can have a channel width which is equal to a forward distance between the left front inward portion and the right front inward portion; and the channel width is further equal to a rearward distance between the left rear inward portion and the right rear inward portion.

In some embodiments, the left rear forward portion is configured to slope from rear to front at a left rear forward radius. The right rear forward portion is configured to slope from rear to front at a right rear forward radius. The left rear forward radius is equal to the right rear forward radius to better guide the handle into the left front capture notch and the right front capture notch. The left rear inward portion is concave with a left rear inward portion radius. The right rear inward portion is concave with a right rear inward portion radius. The left front inward portion is concave with a left front inward portion radius. The right front inward portion is concave with a right front inward portion radius. The left rear inward portion radius is equal to the right rear inward portion radius, the left front inward portion radius and the right front inward portion radius to better guide the handle into the central channel. The left rear forward radius is greater than the left rear inward portion radius.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
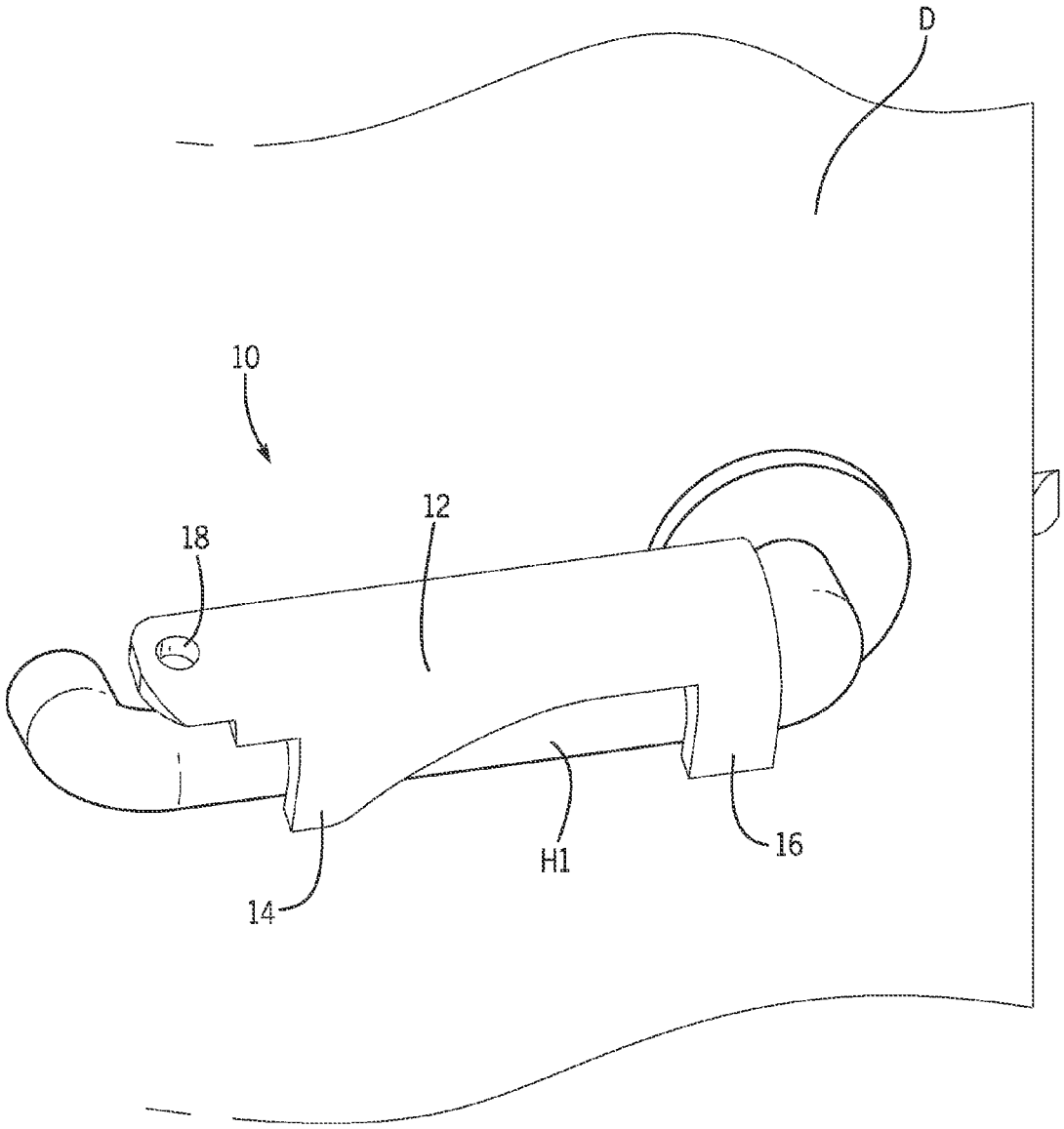
FIG. 1 is a perspective view of an embodiment of the invention in use.

By way of example, and referring to FIG. 1, one embodiment of the present system comprises handle barrier 10. Handle barrier 10 comprises body portion 12 perforated to form tethering portion 18. Body portion further comprises rear double arcuate portion 14 and forward arcuate portion 16. Handle barrier 10 is configured to partially encircle handle H1 enabling a user to rotate handle H1 and thus enter door D attached to handle H1.

Figure 2:
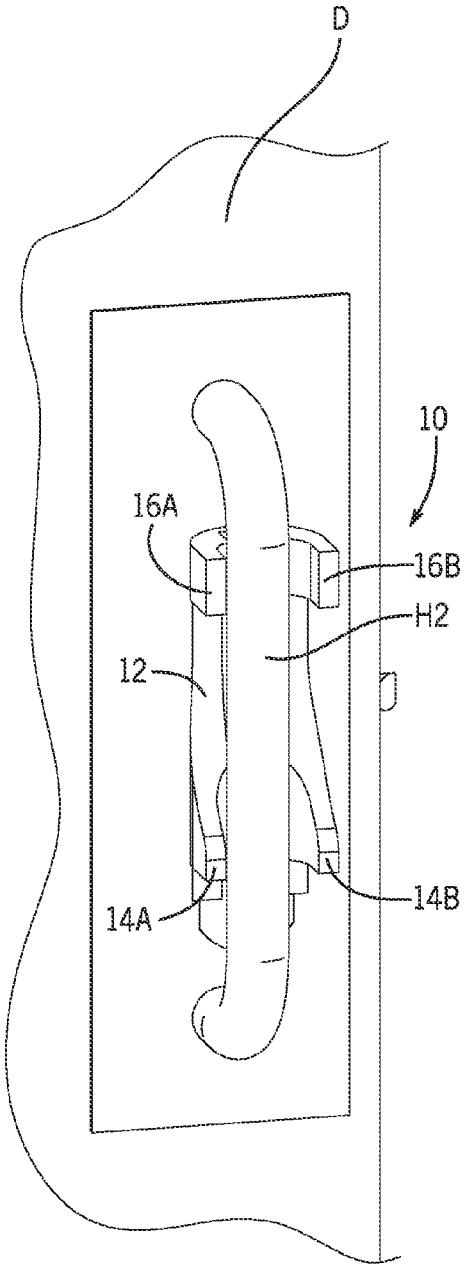
FIG. 2 is another perspective view of an embodiment of the invention in use.
Figure 3:
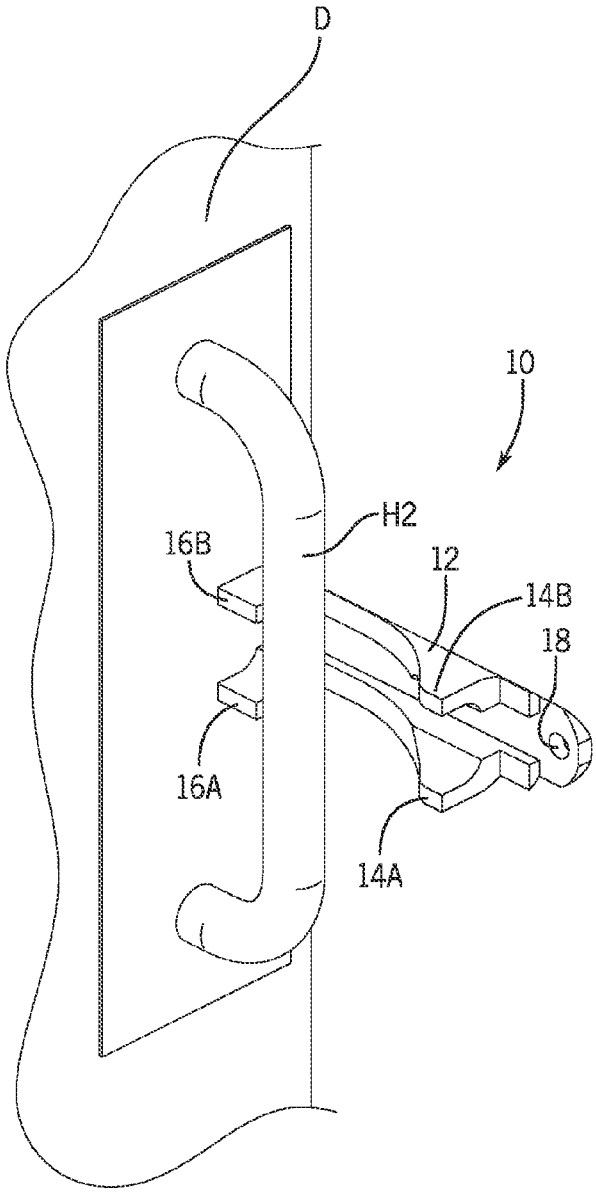
FIG. 3 is another perspective view of an embodiment of the invention in use.

Turning to FIG. 2 and FIG. 3, the handle need not one that can be turned. Here handle H2 is attached to door D such that a user could wrap handle barrier 10 partially around handle H2 and then apply force on handle barrier 10 to move door D. Of course, this works on more than doors and anything with a handle can be moved.

Turning to body portion 12 in more detail. Body portion 12 comprises a rear end having a left rear double arcuate portion 14A and a right rear double arcuate portion 14B. The left rear double arcuate portion 14A has a left rear inward portion which is concave and a left rear forward portion which slopes concave while gradually decreasing in cross sectional area. Likewise, the right rear double arcuate portion 14B has a right rear inward portion which is concave and a right rear forward portion which slopes concave while gradually decreasing in cross sectional area.

The gradually decreasing cross-sectional area portions terminate at the front end of body portion 12. Body portion 12 comprises a front end having a left front arcuate portion 16A and a right front arcuate portion 16B. The left front arcuate portion 16A has a left front inward portion which is concave and a left front rearward portion which is substantially perpendicular to body portion 12. Likewise, the right front arcuate portion 16A has a right front inward portion which is concave and a right front rearward portion which is substantially perpendicular to body portion 12.

Figure 4:
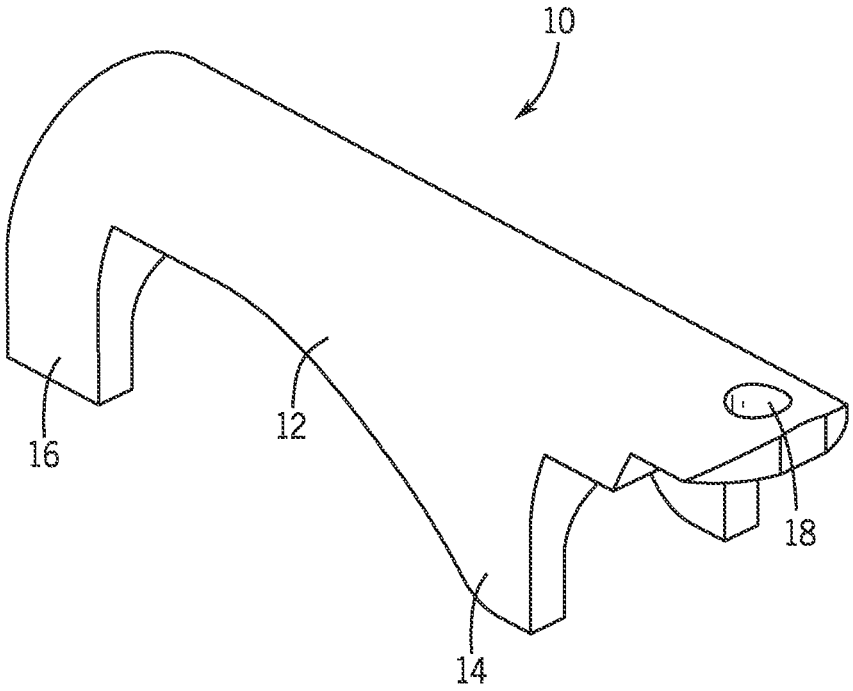
FIG. 4 is a perspective view of an embodiment of the invention.

Turning to FIG. 4, the left rear forward portion has a left rear forward parallel portion which is immediately adjacent to and perpendicular to the left front rearward portion forming a left front capture notch. Likewise, the right rear forward portion has a right rear forward parallel portion which is immediately adjacent to and perpendicular to the right front rearward portion forming a right front capture notch. As shown in FIG. 3, the left front capture notch and the right front capture notch are configured to move handle H2.

Figure 5:
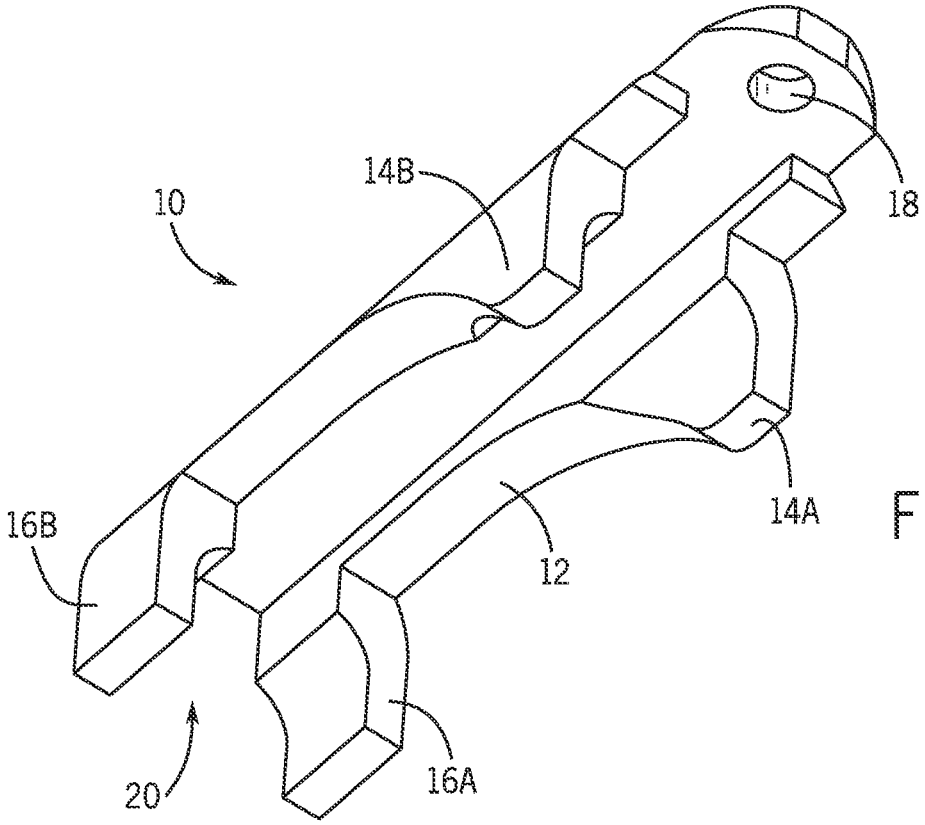
FIG. 5 is another perspective view of an embodiment of the invention.

Turning to FIG. 5, central channel 20 is formed by the left front inward portion, the right front inward portion, the left rear inward portion, and the right rear inward portion. Central channel 20 is configured to accommodate a handle size as large as a forward distance between the left front inward portion and the right front inward portion. In some embodiments, a channel width is equal to a rearward distance between the left rear inward portion and the right rear inward portion. Some handles may be smaller, but those will fit into a parallel piped portion immediately adjacent to body portion 12 and likewise between the left front inward portion, the right front inward portion, the left rear inward portion, and the right rear inward portion.

Figure 6:
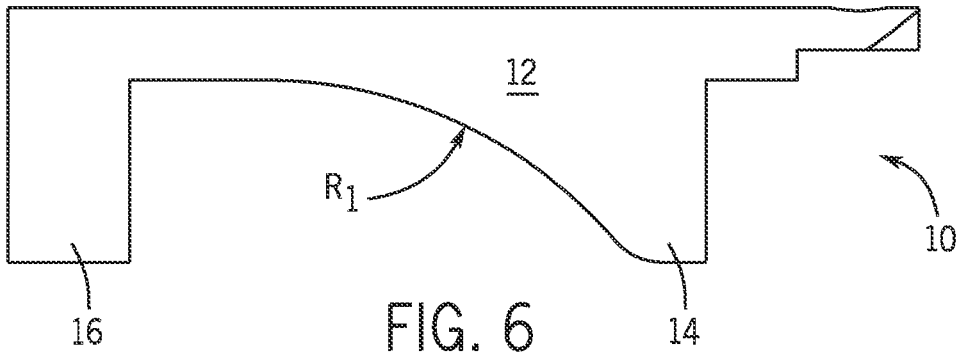
FIG. 6 is a side elevation view.

Turning to FIG. 6, the left rear forward portion slopes from rear to front at left rear forward radius R1. Likewise, the right rear forward portion slopes from rear to front at right rear forward radius R1. In some embodiments, left rear forward radius R1 is equal to right rear forward radius R1 to better guide handle H2 into the left front capture notch and the right front capture notch.

Figure 7:
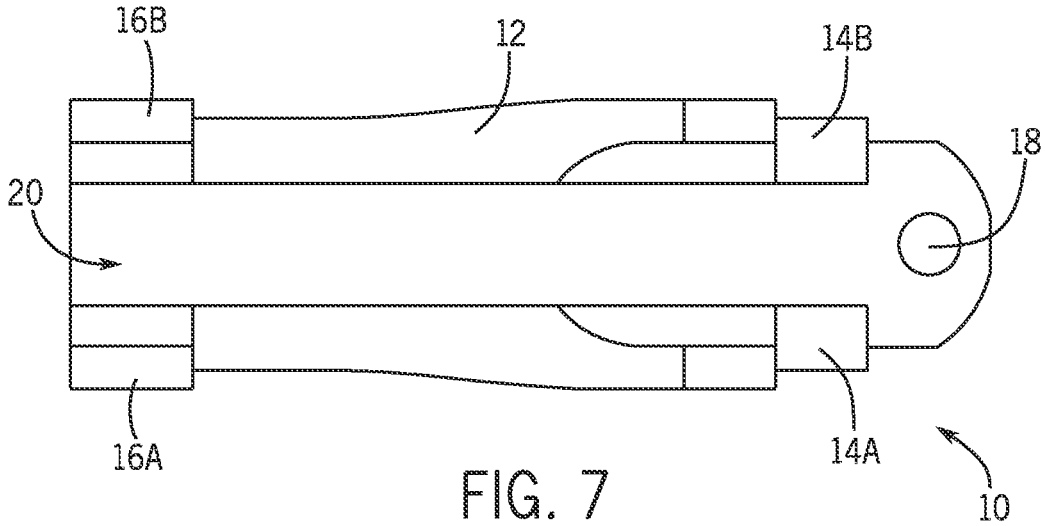
FIG. 7 is a bottom plan view.
Figure 8:
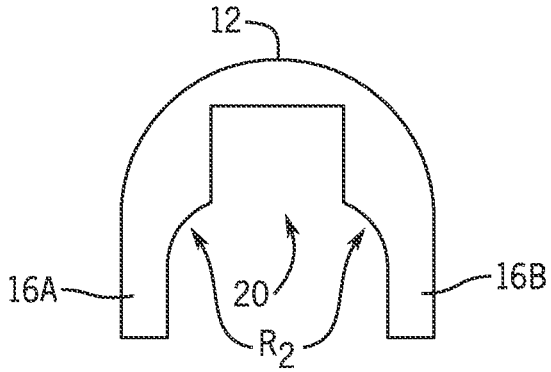
FIG. 8 is an end view.

Turning to FIG. 7 and FIG. 8, the left rear inward portion is concave with left rear inward portion radius R2. The right rear inward portion is concave with right rear inward portion radius R2. The left front inward portion is concave with left front inward portion radius R2. The right front inward portion is concave with right front inward portion radius R2. In some embodiments, left rear inward portion radius R2 is equal to right rear inward portion radius R2, left front inward portion radius R2 and right front inward portion radius R2 to better guide handle H1 into central channel 20. Experimentation has indicated improved results where the left rear forward radius R1 is greater than the left rear inward portion radius R2, but this configuration is not required.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A handle barrier configured to manipulate a handle while keeping a human hand separated from the handle; the handle barrier comprising:

a body portion attached to:

a rear end having a left rear double arcuate portion, a right rear double arcuate portion; and a front end having a left front arcuate portion and a right front arcuate portion;

wherein the left front arcuate portion and the right front arcuate portion are configured perpendicular to the body portion and further configured to accommodate the handle;

wherein the left front arcuate portion, the right front arcuate portion, the left rear double arcuate portion and the right rear double arcuate portion are concave thereby collectively forming a central channel that is configured to accommodate the handle.

2. The handle barrier of claim 1, wherein the left rear double arcuate portion further comprises a left rear inward portion which is concave and a left rear forward portion which slopes forward;

the right rear double arcuate portion further comprises a right rear inward portion which is concave and a right rear forward portion which slopes forward;

the left front arcuate portion has a left front inward portion, which is concave, and a left front rearward portion, which is substantially perpendicular to the body portion; and the right front arcuate portion has a right front inward portion, which is concave, and a right front rearward portion, which is substantially perpendicular to the body portion;

the left rear forward portion has a left rear forward parallel portion which is immediately adjacent to and perpendicular to the left front rearward portion forming a left front capture notch;

the right rear forward portion has a right rear forward parallel portion which is immediately adjacent to and perpendicular to the right front rearward portion forming a right front capture notch;

wherein the left front capture notch and the right front capture notch are configured to accommodate the handle.

3. The handle barrier of claim 2, wherein the central channel is formed by the left front inward portion, the right front inward portion, the left rear inward portion, and the right rear inward portion.

4. The handle barrier of claim 3, wherein the central channel has a channel width which is equal to a forward distance between the left front inward portion and the right front inward portion; and the channel width is further equal to a rearward distance between the left rear inward portion and the right rear inward portion.

5. The handle barrier of claim 2, wherein the left rear forward portion is configured to slope from rear to front at a left rear forward radius; the right rear forward portion is configured to slope from rear to front at a right rear forward radius;

wherein the left rear forward radius is equal to the right rear forward radius to better guide the handle into the left front capture notch and the right front capture notch.

6. The handle barrier of claim 2, wherein the left rear inward portion is concave with a left rear inward portion radius;

the right rear inward portion is concave with a right rear inward portion radius;

the left front inward portion is concave with a left front inward portion radius; and the right front inward portion is concave with a right front inward portion radius;

wherein the left rear inward portion radius is equal to the right rear inward portion radius, the left front inward portion radius and the right front inward portion radius to better guide the handle into the central channel.

7. The handle barrier of claim 2, wherein the left rear forward portion is configured to slope from rear to front at a left rear forward radius; the right rear forward portion is configured to slope from rear to front at a right rear forward radius;

wherein the left rear forward radius is equal to the right rear forward radius to better guide the handle into the left front capture notch and the right front capture notch;

the left rear inward portion is concave with a left rear inward portion radius;

the right rear inward portion is concave with a right rear inward portion radius;

the left front inward portion is concave with a left front inward portion radius; and the right front inward portion is concave with a right front inward portion radius;

wherein the left rear inward portion radius is equal to the right rear inward portion radius, the left front inward portion radius and the right front inward portion radius to better guide the handle into the central channel;

wherein the left rear forward radius is greater than the left rear inward portion radius.

* * * * *